US006666708B2

(12) United States Patent
Saito

(10) Patent No.: US 6,666,708 B2
(45) Date of Patent: Dec. 23, 2003

(54) CONNECTOR

(75) Inventor: Masashi Saito, Yokkaichi (JP)

(73) Assignee: Sumitomo Wiring Systems, Ltd, (JP)

( * ) Notice: Subject to any disclaimer, the term of this patent is extended or adjusted under 35 U.S.C. 154(b) by 19 days.

(21) Appl. No.: 10/067,568

(22) Filed: Feb. 5, 2002

(65) Prior Publication Data

US 2002/0115335 A1 Aug. 22, 2002

(30) Foreign Application Priority Data

Feb. 16, 2001 (JP) ..... 2001-040133

(51) Int. Cl.[7] ..... H01R 13/58

(52) U.S. Cl. ..... 439/466; 439/752; 439/372; 439/881; 439/498

(58) Field of Search ..... 439/466, 473, 439/752, 372, 877, 878, 881, 694, 498, 499, 495

(56) References Cited

U.S. PATENT DOCUMENTS 3,577,119 A * 5/1971 Delyon et al. ..... 439/881
3,920,306 A * 11/1975 Barnett et al. ..... 439/459
4,343,523 A * 8/1982 Cairns et al. ..... 339/59
5,181,867 A * 1/1993 Rodondi et al. ..... 439/854
5,288,242 A * 2/1994 Muzslay ..... 439/349
5,489,224 A * 2/1996 Schwarz ..... 439/752
5,624,287 A * 4/1997 Newman et al. ..... 439/801
5,664,964 A * 9/1997 Crofoot et al. ..... 439/495
6,139,351 A * 10/2000 Schaefer et al. ..... 439/372
6,250,952 B1 * 6/2001 Shiga et al. ..... 439/466
6,273,756 B1 * 8/2001 Ward et al. ..... 439/607
6,354,890 B2 * 3/2002 Adkins et al. ..... 439/843

FOREIGN PATENT DOCUMENTS

JP 2-32676 1/1990

* cited by examiner

*Primary Examiner*—Truc Nguyen
(74) *Attorney, Agent, or Firm*—Gerald E. Hespos; Anthony J. Casella

(57) ABSTRACT

A connector has L-shaped female terminal fittings (42), and wires (70) are fastened to a wire fastening portion (55) at one side of the L-shaped female terminal fitting (42). The female terminal fittings (42) are accommodated in a connector housing, and the wires (70) are pulled out in a direction normal to a connector connecting direction. Thus it is not necessary to provide a space to bend the wires (70) behind the connector with respect to the connecting direction, and the wires (70) can be handled easily even if there is little space behind the connector.

8 Claims, 11 Drawing Sheets

CONNECTOR

BACKGROUND OF THE INVENTION

1. Field of the Invention

The present invention relates to a connector.

2. Description of the Related Art

A wiring harness 1 of an automotive vehicle includes a known female connector 2 and is disposed in proximity to an inner wall 3 of the automotive vehicle, as shown in FIG. 11. A male connector 4 projects from the inner wall 3 and is configured for connection to the female connector 2. The female connector 2 has a housing 5 with a plurality of cavities that open to the rear of the housing 5. Terminal fittings (not shown) are secured to the ends of each of a plurality of wires 1A of the wiring harness 1 and are accommodated in the cavities of the connector housing 5. The wires 1A extend back from the connector housing 5 and are bent sideways at positions spaced from the connector housing 5.

The wires 1A must project from the rear of the connector housing 5 by a distance L1 to achieve a natural bend of the wires 1A. However, the wires 1A often are bent forcibly if there is insufficient space behind the connector 2, and the forcibly bent wires 1A are subjected to a large stress. Further, it is difficult to push the connector 2 into the mating connector 4 if there is insufficient space behind the connector 2.

In view of the above situation, an object of the present invention is to provide a connector which enables an easy handling of wires and an easy connecting operation even if a reduced space can be provided behind the connector with respect to its connecting direction.

SUMMARY OF THE INVENTION

The invention is directed to a connector that comprises a connector housing. At least one terminal fitting is fastened to an end of a wire and is insertable into the connector housing. Each terminal fitting is substantially L-shaped and has a wire fastening portion fastened to the wire along a side of the terminal fitting that intersects a connector connecting direction, and that preferably is substantially normal to the connector connecting direction.

The terminal fittings preferably are locked in the connector housing by a retainer. The retainer is placed at the rear end of the terminal fittings and is locked in the connector housing. Thus, the wires are fastened to the wire fastening portions of the respective L-shaped terminal fittings, and are pulled out in a direction that intersects the connector connecting direction when the terminal fittings are accommodated in the connector housing. Therefore, unlike the prior art, it is not necessary to provide a sufficient space behind the connector to bend the wires with a bending radius that will not damage the wires or subject the wires to excessive stress and strain forces. As a result, the wires can be handled easily even if no wide space can be provided behind the connector. Further, the terminal fittings are locked by placing the retainer at the rear end of the terminal fittings with respect to the inserting direction of the terminal fittings into the connector housing.

The retainer preferably comprises locking means to be locked with mating locking means on the connector housing and at least one projecting portion that abuts the terminal fittings to lock them into the connector housing.

The L-shaped terminal fittings may be accommodated at a plurality of stages in the connector housing such that the terminal fittings at one stage are displaced obliquely backward from the terminal fittings at another stage. Thus, the female terminal fittings adjacent to each other at different stages can also be adjacent to each other along the wire fastening portions, thereby enabling the connector housing to be more compact.

The terminal fittings preferably are at two stages in the connector housing such that the terminal fittings at one stage and those at the other stage are oriented oppositely. Thus, the female terminal fittings adjacent to each other at different stages also can be adjacent along the wire fastening portions, thereby enabling the connector housing to be more compact.

The connector may further comprise a slider that is slid at an angle to the connector connecting direction. The slider preferably comprises a cam mechanism for pulling the connector housing and a mating connector housing together and connecting them with each other as the slider is slid. Therefore, the connectors can be connected easily with each other even if no wide space can be provided behind the connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
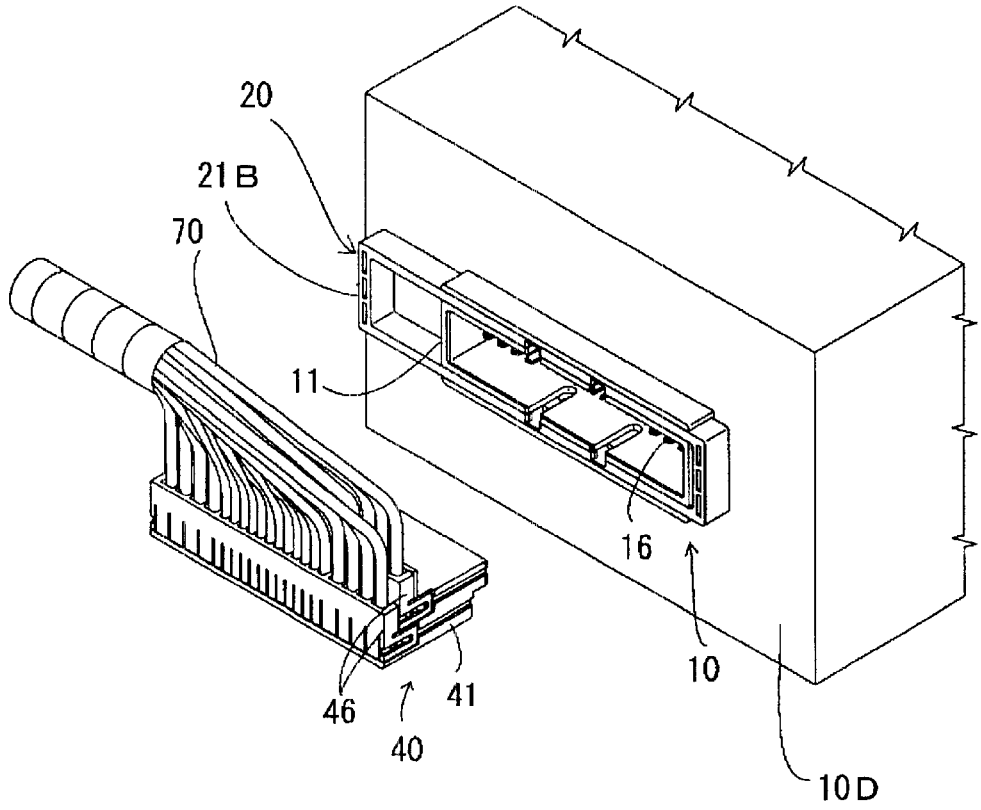
FIG. 1 is a perspective view of male and female connectors according to a first embodiment of the present invention.

A male connector in accordance with the invention is identified by the numeral 10 in FIG. 1. The male connector 10 has a male housing 11 substantially in the form of a transversely long receptacle.

Figure 2:
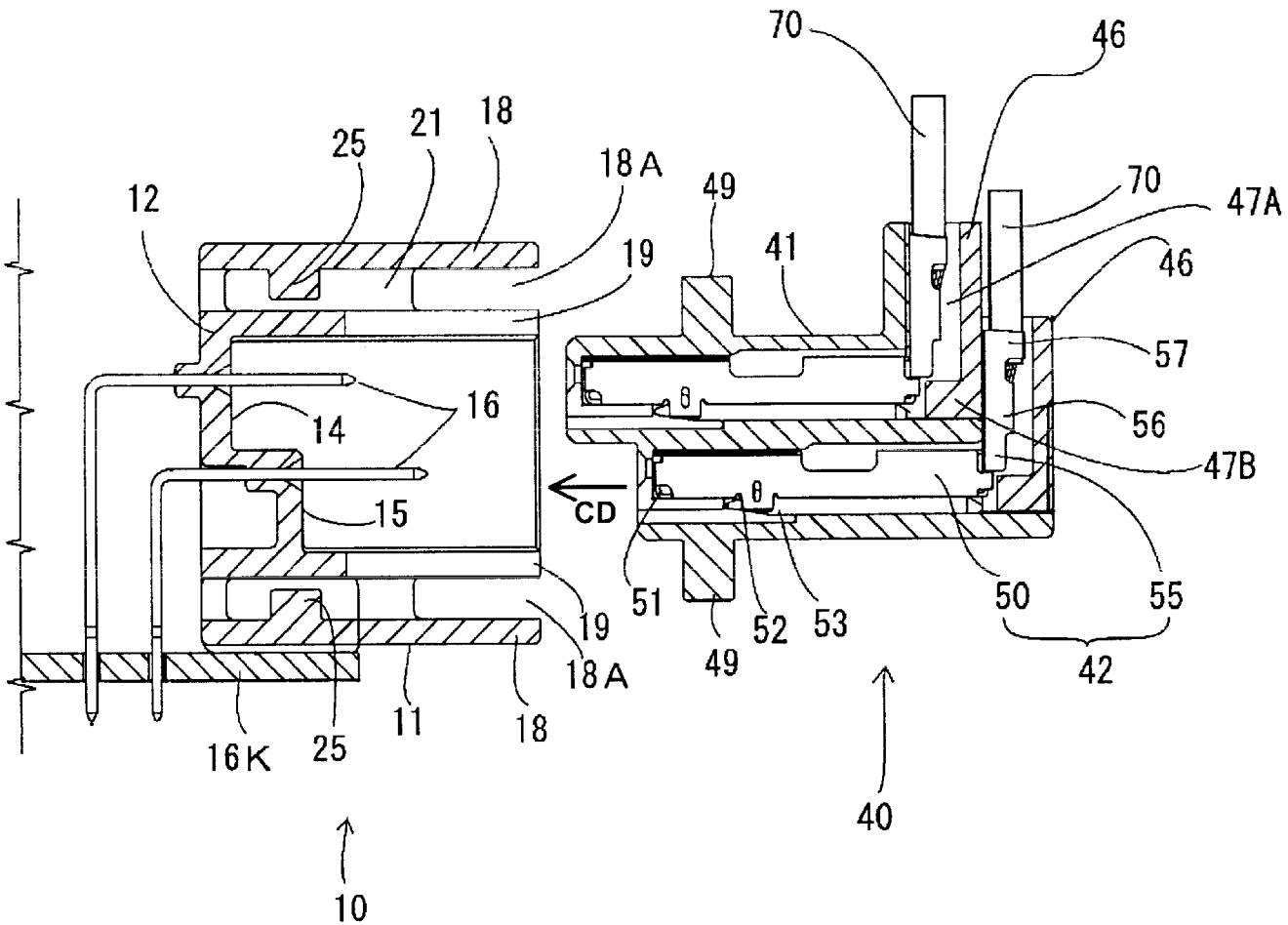
FIG. 2 is a side view in section of the male and female connectors.

The male housing 11 is secured, for example, to an inner wall 10D of a body of an automotive vehicle, and a back wall 12 of the male housing 11 is stepped so that an upper surface 14 is more backward than a lower back surface 15, as shown in FIG. 2. Male tabs 16 project from the back surfaces 14, 15. More specifically, each male tab 16 is formed by bending a substantially rectangular plate at substantially a right angle into a substantially L-shape. The male tabs 16 are arranged substantially side by side at two or more stages, and one side of each male tab 16 penetrates the back surface 14, 15 of the back wall 12. The base end of each male tab 16 extends down in FIG. 2 behind the male housing 11, and is inserted through a pinhole of a circuit board 16K for connection to a pattern laid on the circuit board 16K.

Figure 3:
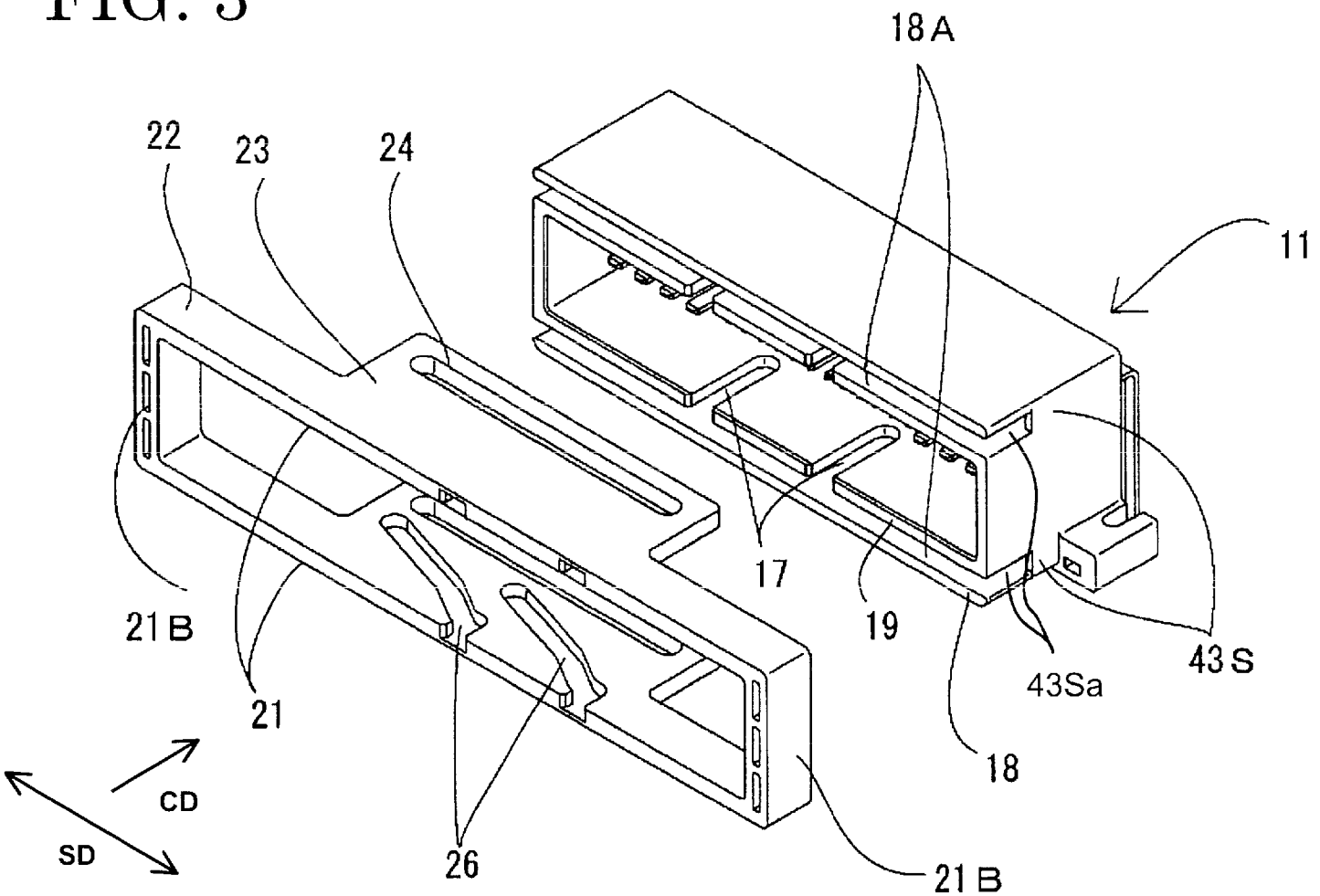
FIG. 3 is an exploded perspective view of the male connector.

The top and bottom of the male housing 11 in FIG. 2 have a double wall comprised of opposed outer and inner walls 18 and 19. The outer and inner walls 18, 19 extend from opposite rear corners of the male housing 11 along the rear edges and are connected with surrounding walls 43S, as shown in FIG. 3. Clearances 18A are defined between the outer and inner walls 18, 19 and are open at the front surface and at the side surfaces of the front corners of the male housing 11. A slider 20 is mounted in the clearances 18A.

The slider 20 is in the form of a rectangular frame, and has opposed substantially flat plates 21 and operable portions 21B that connect the opposite ends of the flat plates 21, as shown in FIG. 3. The flat plates 21 can be mounted into the clearances 18A between the inner and outer walls 18, 19. Each flat plate 21 has a projecting piece 23 that projects toward the clearance 18A from a middle portion of a rectangular plate 22. A guide groove 24 is formed at the leading end of the projecting piece 23 and extends normal to a connecting direction CD of the male and female connectors 10, 40. Guide projections 25 are formed at the back of the clearances 18A and project from the outer wall 18 toward the inner wall 19, as shown in FIG. 2. The projecting pieces 23 of the slider 20 can be pushed into the clearances 18A to deform the outer walls 18 resiliently outwardly. The outer walls 18 then are restored to their original shapes to fit the guide projections 25 into the guide grooves 24. Thus, the slider 20 is locked in the clearances 18A and is slideable in a sliding direction SD that intersects the connecting direction CD at an angle of preferably 90° to the connector connecting direction CD. Furthermore, recesses 43Sa in the surrounding wall 43S enable slider 20 to slide laterally in a direction that intersects the connecting direction CD.

Figure 6:
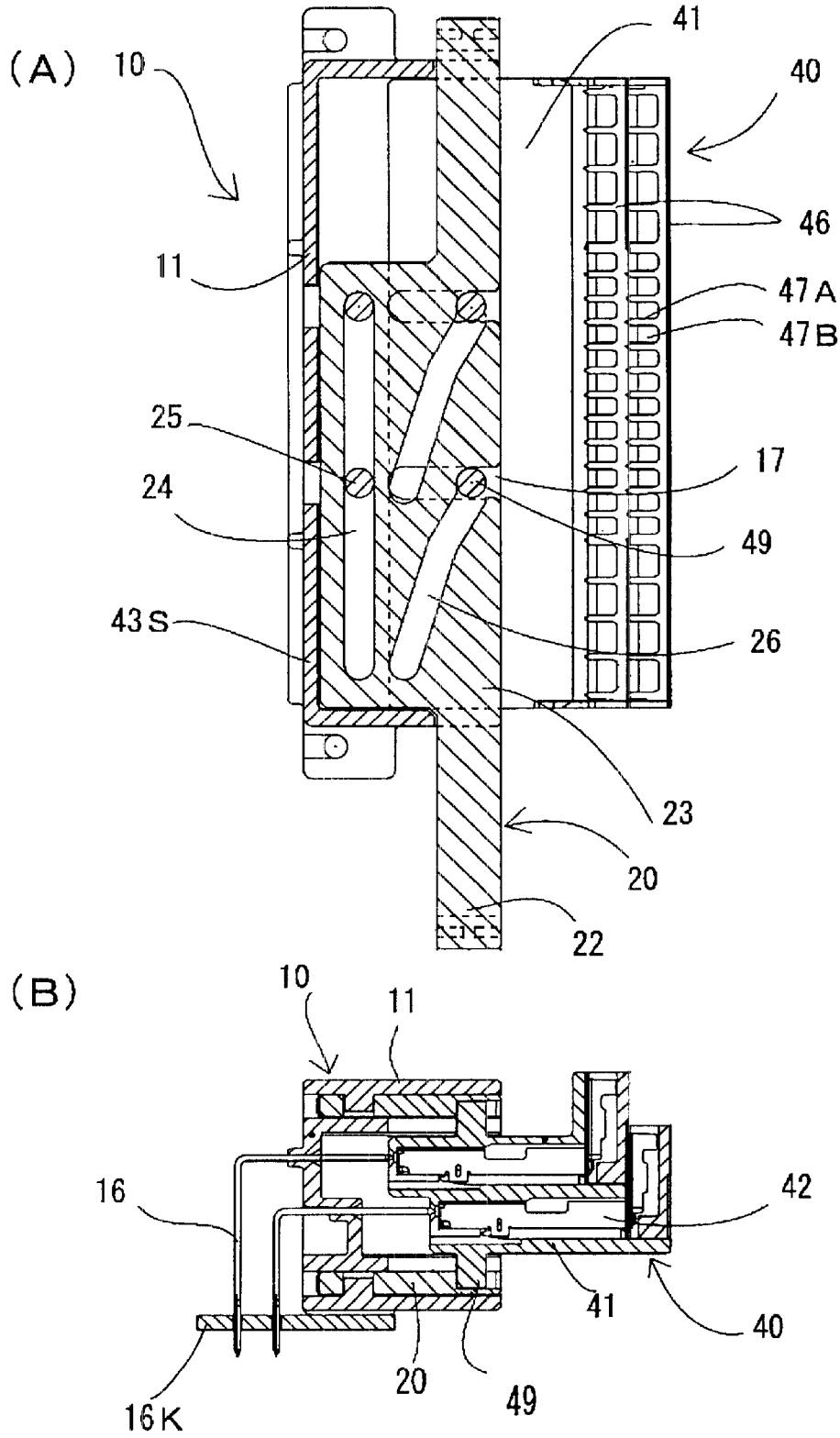
FIGS. 6(A) and 6(B) are a plan view in section and a side view in section of the male and female connectors at an initial stage of a connecting operation.

Each flat plate 21 has two cam grooves 26 that extend obliquely toward the guide groove 24 as shown in FIG. 3. The cam grooves 26 are open at the front ends of the flat plates 21. Each inner wall 19 of the male housing 11 is formed with two grooves 17 that extend substantially along the connector connecting direction CD and correspond to the cam grooves 26. Each groove 17 is open at the front end of the inner wall 19. The openings of the cam grooves 26 and the grooves 17 are in agreement with the slider 20 at one end of its slideable range, as shown in FIG. 6(A).

Figure 4:
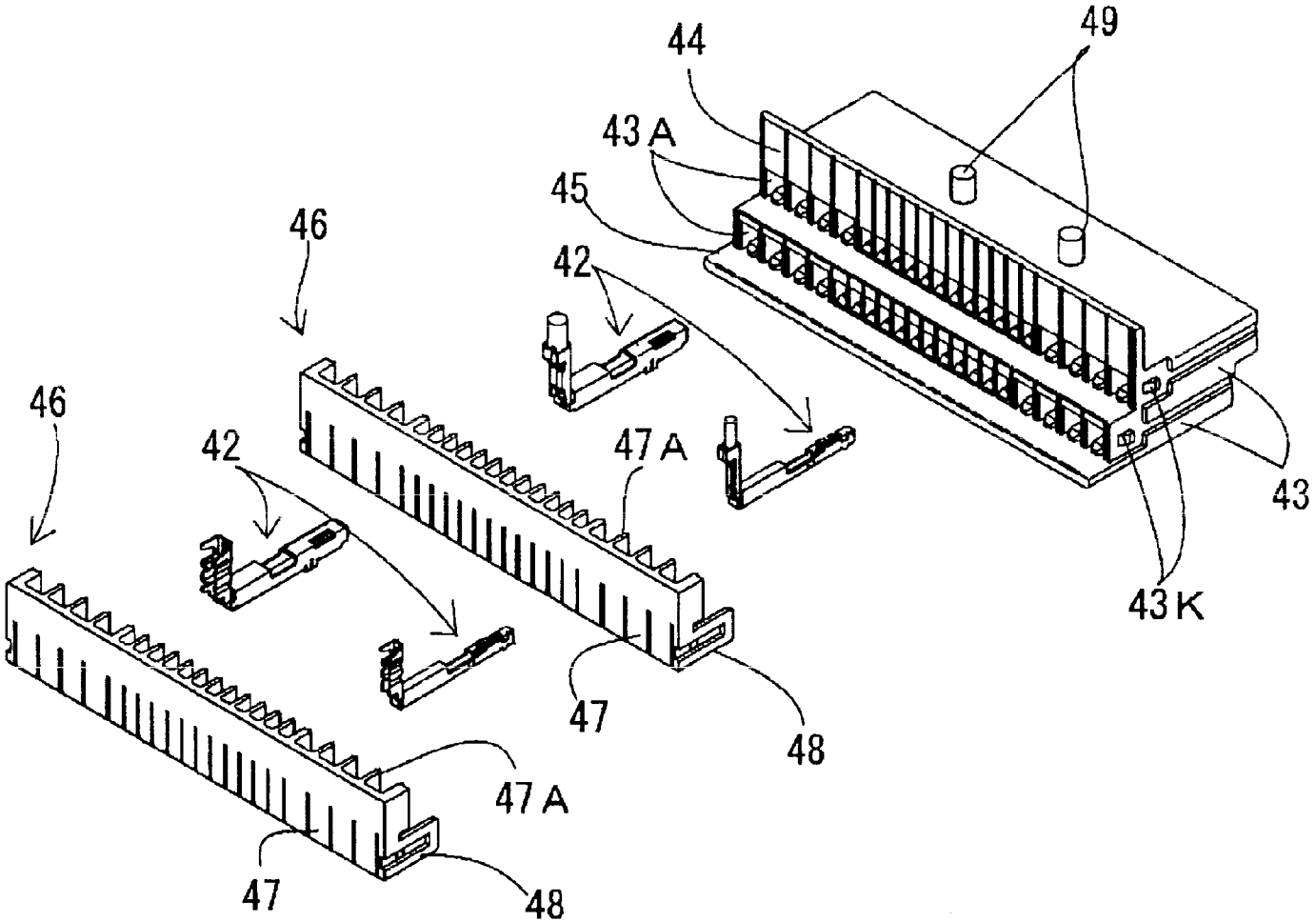
FIG. 4 is an exploded perspective view of the female connector.

The female connector 40 has a female housing 41 that is transversely long and substantially conforms to the configuration of the male housing 11, as shown in FIG. 1. The female housing 41 has cavities 43 in at least two stages for accommodating female terminal fittings 42, as shown in FIG. 4. The upper cavities 43 are displaced forward from the lower cavities 43 with respect to the connector connecting direction CD. Thus, the front end surface of the female housing 41 is stepped to align with the back surfaces 14, 15 of the male housing 11.

Figure 5:
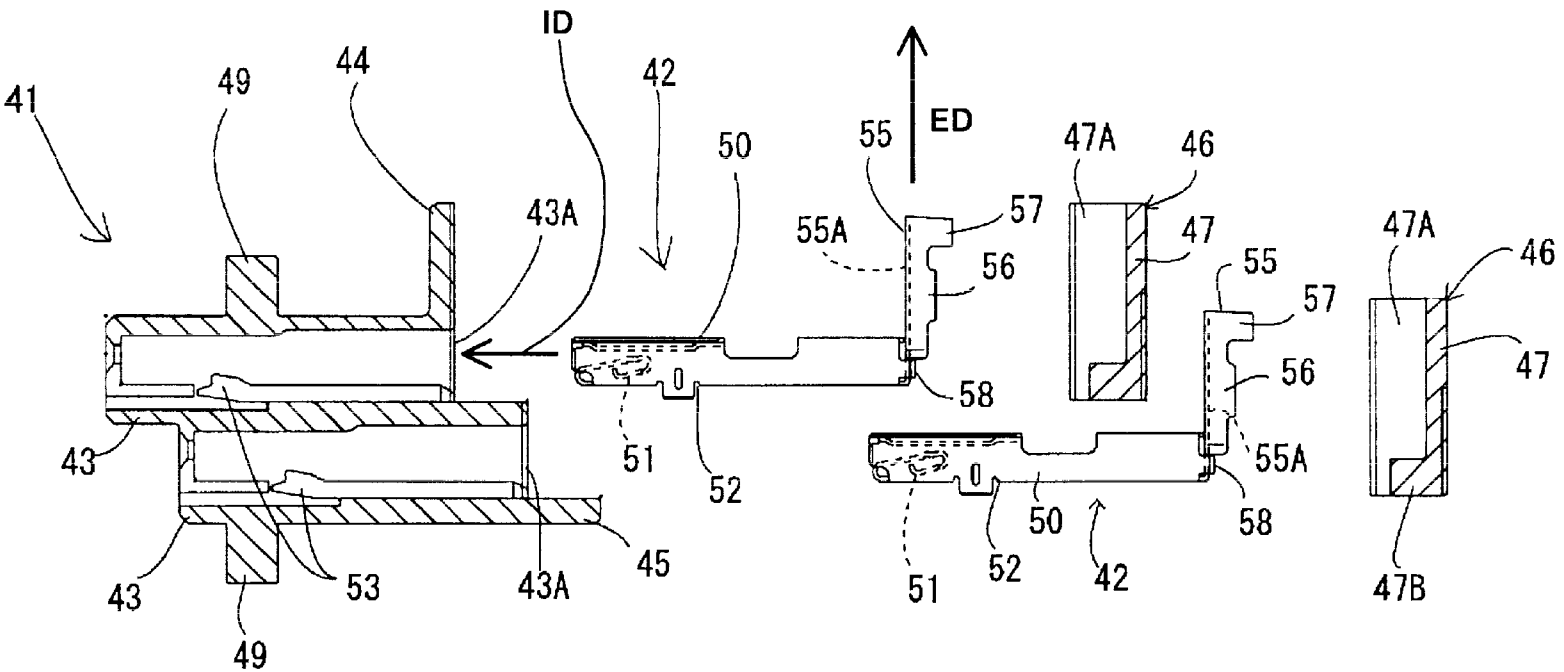
FIG. 5 is an exploded side view in section of the female connector.

The rear end surface of the female housing 41 also is stepped, so that terminal insertion openings 43A of the upper and lower cavities 43 are displaced forward and backward with respect to a terminal inserting direction. An auxiliary wall 44 extends up from the rear edge of the upper surface of the female housing 41, whereas a bottom wall 45 extends back from the rear edge of the bottom of the female housing 41. Further, substantially cylindrical cam followers 49 project from each of the upper and bottom surfaces of the female housing 41, as shown in FIGS. 4 and 5.

Retainers 46 are mounted at the rear end of the female housing 41, and are opposed to the terminal insertion openings 43A of the respective cavities 43. Each retainer 46 has a substantially rectangular plate 47 and locking claws 48 extend toward the female housing 43 from opposite ends of the rectangular plate 47. The locking claws 48 engage locking projections 43K at the opposite outer side surfaces of the cavities 43, as shown in FIG. 4. Each rectangular plate 47 has a plurality of projecting pieces 47A that abut against partition walls between adjacent terminal insertion openings 43A. Further, projections 47B are formed between adjacent projecting pieces 47A and project toward the terminal insertion openings 43A, as shown in FIG. 5. The female terminal fittings 42 are locked in the cavities 43 by bringing the projections 47B into abutment against the rear ends of terminal main bodies 50 of the female terminal fittings 42.

Two kinds of female terminal fittings 42 are provided respectively for thin wires and thick wires, as shown in FIG. 4. However, these two kinds of female terminal fittings 42 have a common basic construction. In particular, each female terminal fittings 42 has a substantially rectangular tubular wire fastening portion 55 that extends up from the rear end of the terminal main body 50, as shown in FIG. 5.

Each wire fastening portion 55 is formed from a flat plate 55A that extends from the bottom wall of the terminal main body 50. The flat plate 55A is bent at an angle, and preferably a right angle. Opposite lateral ends of the flat plate 55A are bent to face each other and to form a wire barrel 56 and an insulation barrel 57. Auxiliary claws 58 extend from the rear ends of the side walls of the terminal main body 50 and engage the base end of the flat plate 55A so that the wire fastening portion 55 remains in an extending direction ED arranged at an angle and preferably a right angle to the insertion direction ID. As shown in FIG. 2, a core is exposed from an insulation coating at an end of a wire 70. The core and the insulation coating are placed in the wire barrel 56 and in the insulation barrel 57 which then are crimped, folded or bent into connection with the wire 70.

A tongue 51 is at the front of the terminal main body 50, as shown in FIG. 5, and is brought resiliently into contact with a mating male tab 16. The bottom surface of the terminal main body 50 is formed with a locking hole 52. A lock 53 is cantilevered into the cavity 43 for engagement with the locking hole 52 for partly locking the female terminal fitting 42 in the cavity 43. The retainers 46 are mounted into the female housing 41 from behind for fully locking the female terminal fittings 42 in the cavities 43. Specifically, the female terminal fittings 42 are mounted into the upper cavities 43, and then the retainer 46 is mounted from behind. The female terminal fittings 42 then are mounted into the lower cavities 43, and the retainer 46 is mounted from behind. In this state, the wires 70 extend up from the rear end of the female housing 41 and are bent sideways and bundled e.g. by tape into a wiring harness.

Figure 7:
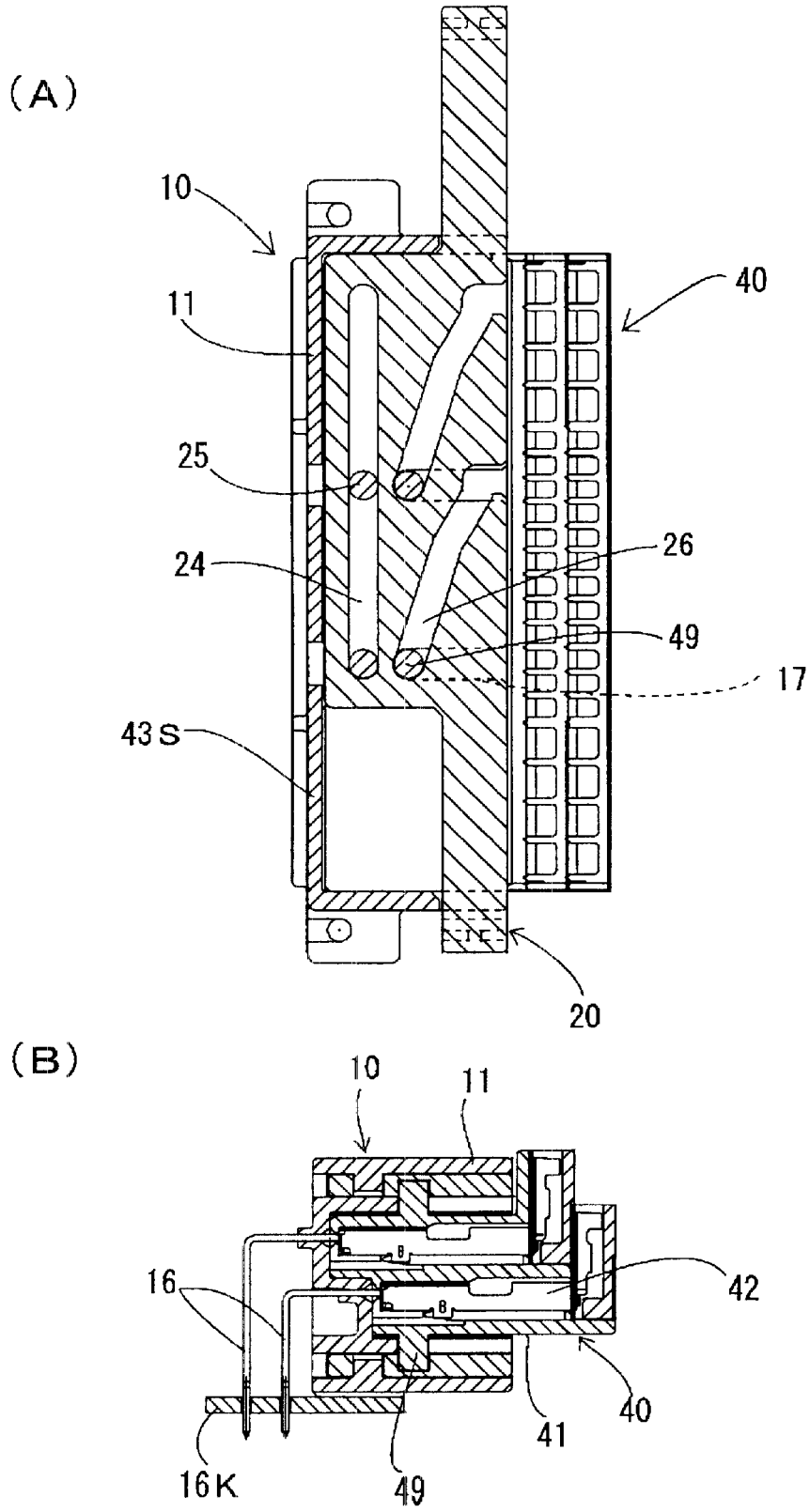
FIGS. 7(A) and 7(B) are a plan view in section and a side view in section of the male and female connectors after completion of the connecting operation.
Figure 8:
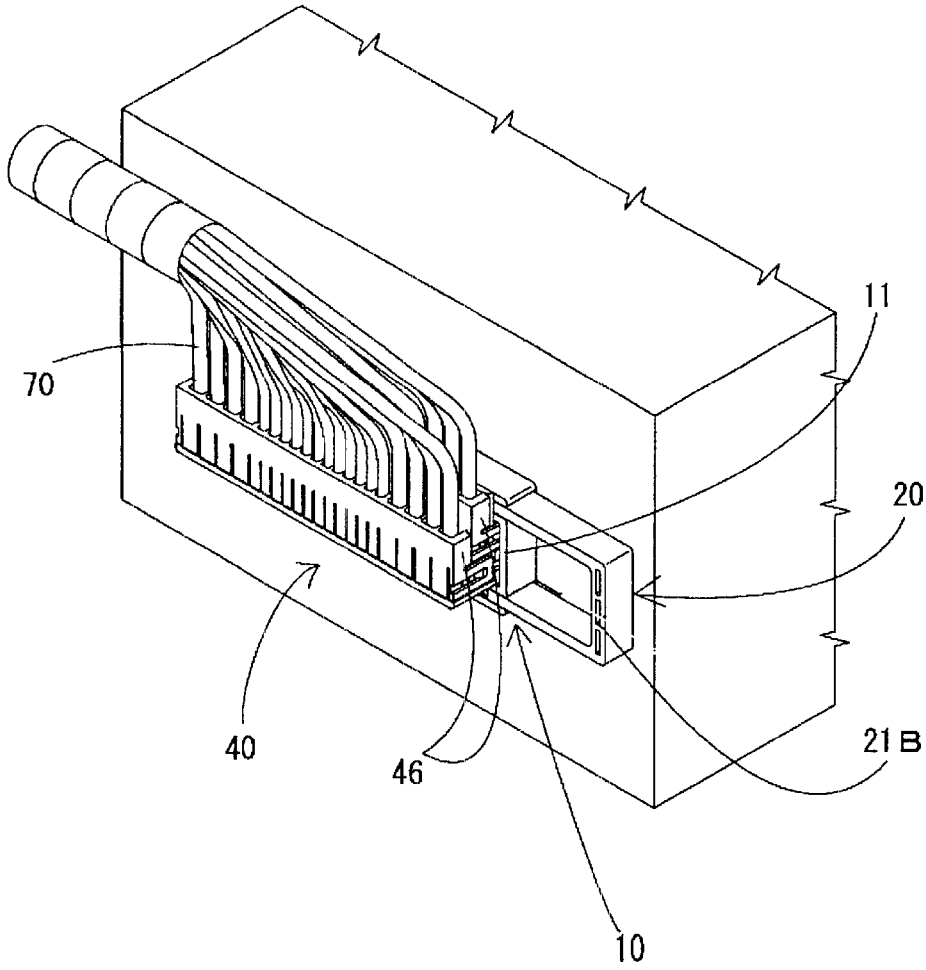
FIG. 8 is a perspective view showing the completely connected male and female connectors.

The female and male connectors 10, 40 are connected by first bringing the slider 20 to one end of its slideable range and aligning the openings of the cam grooves 26 with those of the grooves 17, as shown in FIG. 6(A). The female housing 41 is fit into the male housing 11 in this state. Thus, the cam followers 49 on the female housing 41 enter the cam grooves 26 through the openings aligned with those of the grooves 17. The slider 20 is slid in this state, so that the connectors 10, 40 are pulled toward and connected with each other, as shown in FIGS. 7(A), 7(B) and 8. The slider 20 is operated in the sliding direction SD, which preferably is substantially normal to the connector connecting direction CD. Thus, the two connectors 10, 40 can be connected easily even if there is no wide space behind the female connector 40. The slider 20 may be slid in the opposite direction to detach the male and female connectors 10, 40 from each other.

Wires 70 are fastened to the wire fastening portions 55 at one side of the substantially L-shaped female terminal fittings 42. The wires 70 are pulled from the female housing 41 in the extending direction ED, when the female terminal fittings 42 are accommodated in the female housing 41. The extending direction ED preferably is substantially normal to the connector connecting direction CD. Thus, it is not necessary to provide a space to bend the wires 70 naturally at the rear side with respect to the connector connecting direction CD. Thus, the wires can be handled easily even if no wide space can be provided behind the connector with respect to the connecting direction CD. The female terminal fitting 42 of one stage can be displaced by a specified distance along the inserting direction ID with respect to the female terminal fitting 42 in another stage. Thus, the female terminal fittings 42 adjacent to each other at different stages can also be adjacent to each other along the wire fastening portions 55, thereby making the female housing 41 more compact.

Figure 9:
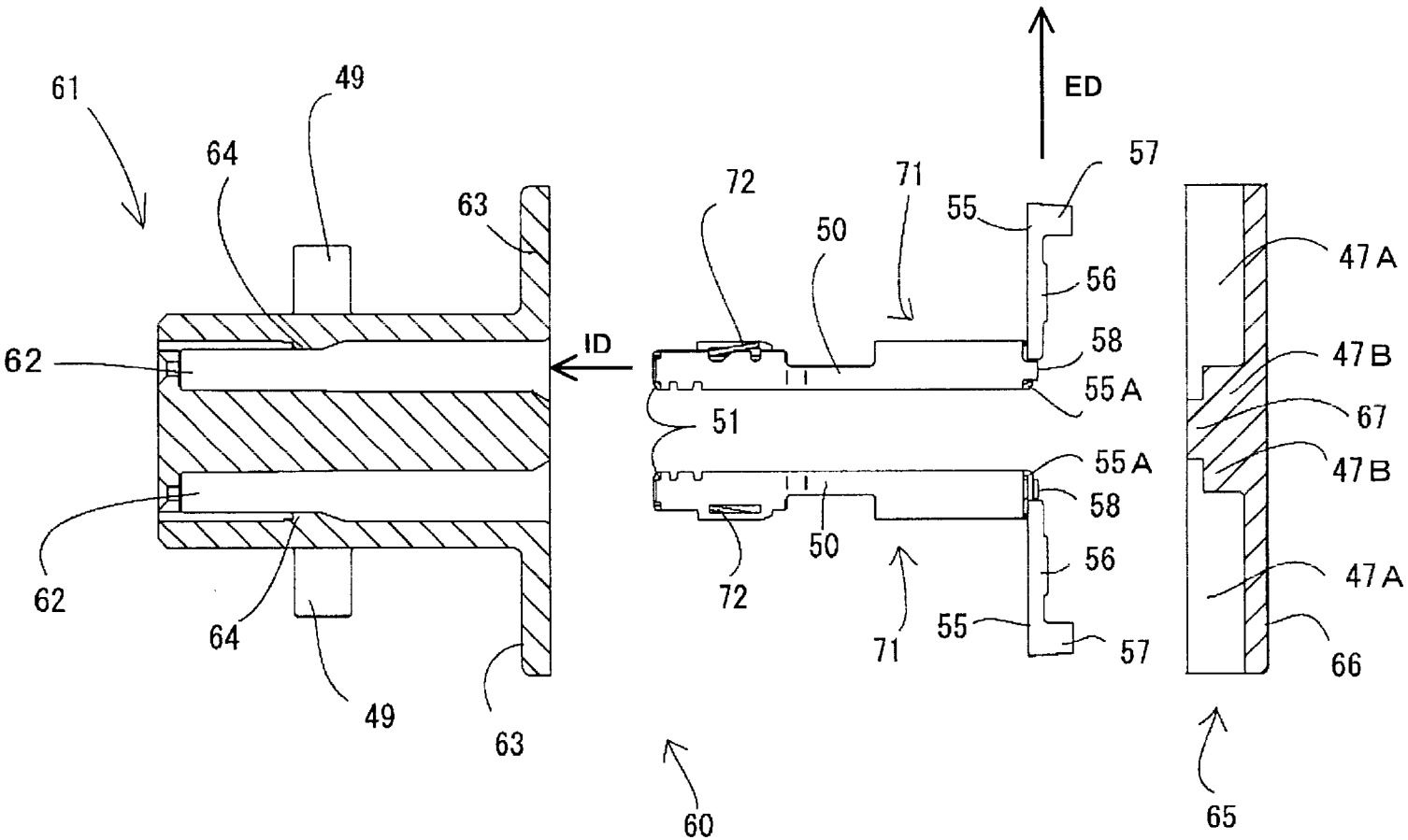
FIG. 9 is an exploded side view in section of a female connector according to a second embodiment.
Figure 10:
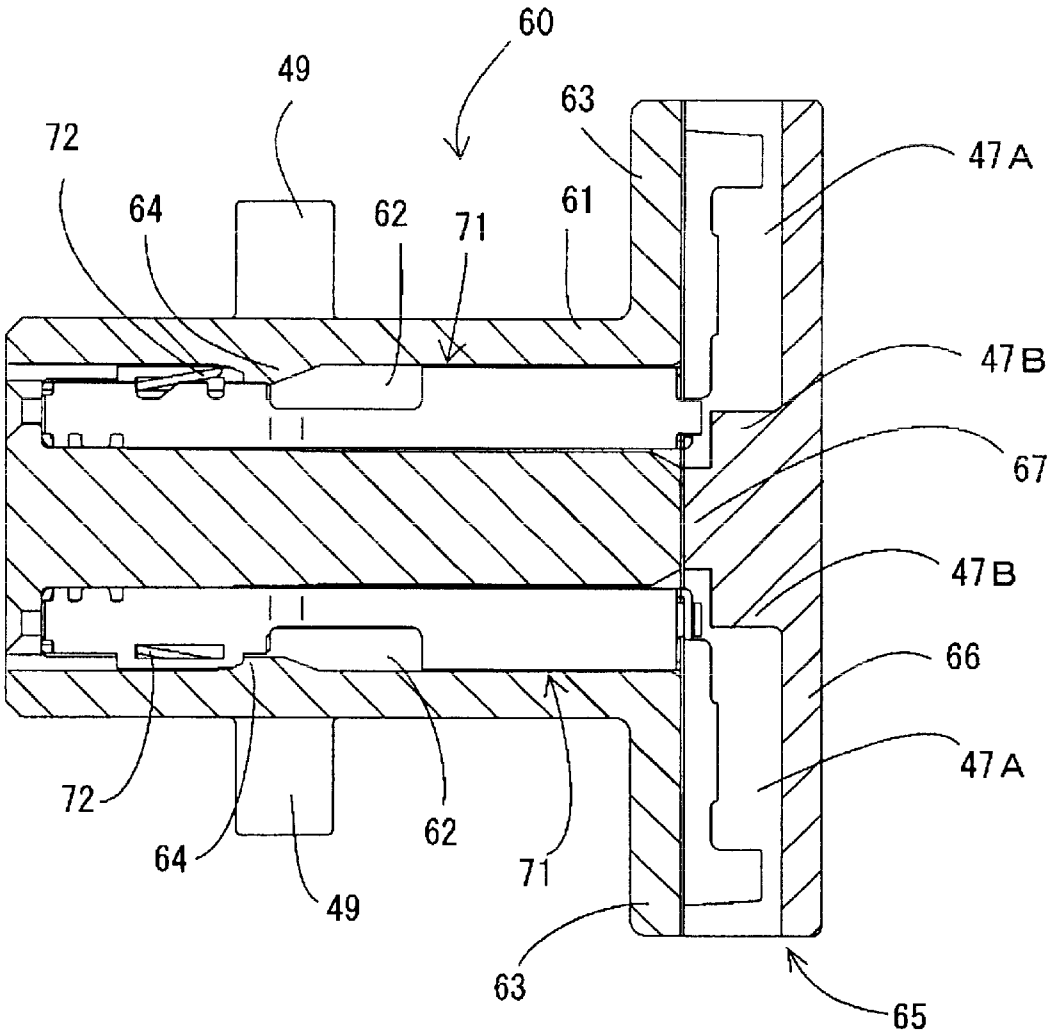
FIG. 10 is a side view in section of the female connector of FIG. 9.
Figure 11:
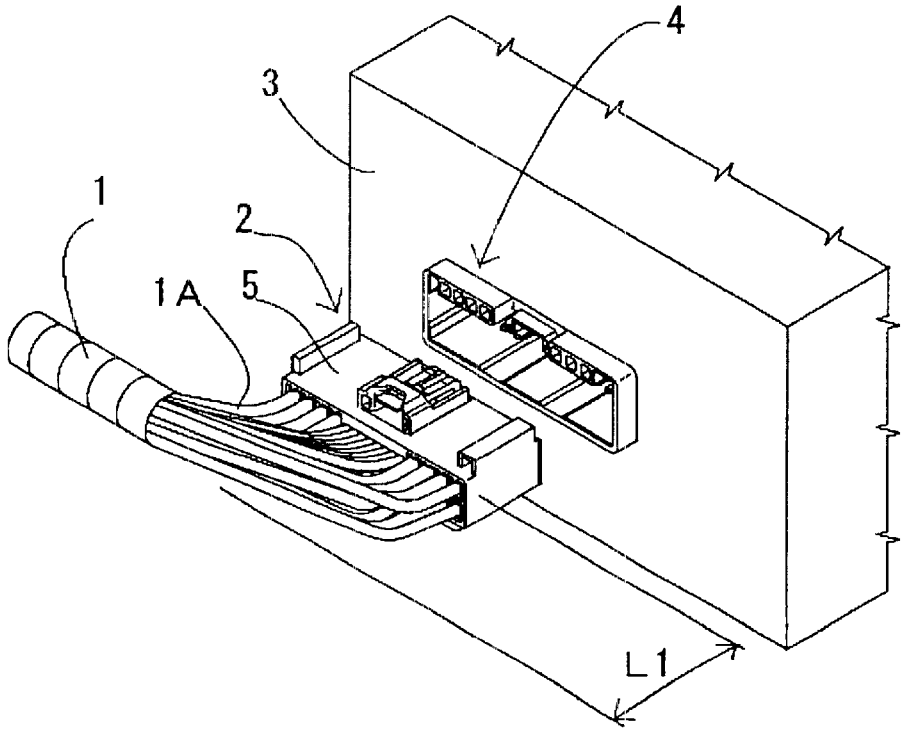
FIG. 11 PRIOR ART
FIG. 11 is a perspective view of a prior art connector.

A female connector 60 according to a second embodiment is shown in FIGS. 9 and 10. The female connector 60 includes a female connector housing 61 with cavities 62 arrayed at two or more stages. The cavities 62 are arranged so that their front and rear surfaces are substantially flush at both stages without being displaced as in the first embodiment. Auxiliary walls 63 stand up and down from the rear end of the female housing 61, and projections 64 for locking female terminal fittings 71 in the cavities 62 are formed on the ceiling surfaces of the cavities 62 at the upper stage and on the bottom surfaces of the cavities 62 at the lower stage.

The female terminal fittings 71 are identical to the female terminal fittings 42 of the first embodiment except that metal locks 72 are provided for locking the terminal fittings 71, as shown in FIG. 9. Each metal lock 72 is formed by making a cut in a surrounding wall of the terminal main body 50 and bending the cut portion to extend obliquely backward with respect to a terminal inserting direction. The metal locks 72 move over the projections 64 and engage the back sides of the projections 64 when the female terminal fittings 71 are inserted into the corresponding cavities 62 to achieve partial locking. The female terminal fittings 71 are locked fully by mounting a retainer 65 on the rear end surface of the female housing 61, as shown in FIG. 10.

The retainer 65 has a flat plate 66 substantially corresponding to dimensions from the upper end of the upper auxiliary wall 63 to the bottom end of the lower auxiliary wall 63. A projected portion 67 projects from the flat plate 66 toward a middle portion of the female housing 61 between the upper and lower cavities 62. Unillustrated locking claws extend from opposite ends of the retainer 65 toward the female housing 61 and are engaged with and fixed to the female housing 61.

The other construction is the same as or similar to the construction of the first embodiment, and no repetitive description is given thereon by identifying it by the same reference numerals.

In this embodiment as well, wires fastened to the wire fastening portions 55 of the L-shaped female terminal fittings 71 are pulled out in the extension direction ED. The extension direction ED is substantially normal to the connector connecting direction CD as in the first embodiment. Therefore, even a case where insufficient space can be provided behind the connector with respect to the connecting direction can be dealth with.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The wires 70 are pulled out upward in FIG. 1 from the rear end of the female housing 41, bent sideways and bundled in the first embodiment. However, they may be pulled up in FIG. 1 and bundled. Thus, the wiring harness may extend up.

The front surface of the female housing 41 according to the first embodiment is stepped. However, it may be flat if the terminal main bodies 50 of the female terminal fittings 42 to be accommodated in the lower cavities 43 are made longer than those of the female terminal fittings 42 to be accommodated in the upper cavities 43.

Although the female terminal fittings 42 are accommodated at two stages in the female housing 41 of the first embodiment, they may be accommodated at one, three or more stages in the female housing.

Although the slider 20 is assembled into the male housing 11 in the foregoing embodiment, it may be assembled into the female housing.

What is claimed is:

1. A connector assembly comprising a first connector with a first connector housing connectable with a second connector housing along a connector connecting direction, the second connector housing having first and second stages of second terminal fittings, the first stage of second terminal fittings being offset on the second connector housing along the connector connecting direction with respect to the second stage of second terminal fittings, a plurality of L-shaped terminal fittings mounted in the first connector housing, each said L-shaped terminal fitting having a terminal main body inserted in the first connector housing along an inserting direction, each said terminal fitting further having a wire fastening portion fastenable to a wire and extending in an extending direction that intersects the connector connecting direction, the substantially L-shaped terminal fittings being accommodated at first and second stages in the first connector housing such that the substantially L-shaped terminal fittings in the first stage are displaced obliquely back from the L-shaped terminal fittings at the second stage with respect to the inserting direction of the terminal fittings into the first connector housing by a distance substantially equal to the offset of the second terminal fittings in the respective first and second stages of the second connector housing, such that the L-shaped terminal fittings in the first and second stages mate with the second terminal fittings in the first and second stages substantially simultaneously, the wire fastening portions of the L-shaped terminal fittings in the first and second stages defining first and second substantially parallel arrays of wire fastening portions offset from one another relative to the connector connecting direction and extending along the extending direction, such that the wire fastening portions of the first and second stages avoid interference with one another.

2. The connector of claim 1, wherein the connector further comprises at least one retainer locked in the connector housing and engaging a plurality of said terminal fillings adjacent the wire fastening portion for locking the terminal fittings in the connector housing.

3. The connector of claim 1, further comprising a slider which is slidable in a sliding direction arranged at an angle to the connector connecting direction.

4. The connector of claim 2, wherein the retainer comprises locking means for locking with the connector housing and at least one projecting portion abutting the terminal fillings to lock the terminal fittings into the connector housing.

5. A connector according to claim 3, wherein the slider comprises a cam mechanism for pulling the connector housing and a mating connector housing together and connecting them with each other as the slider is slid.

6. A connector with a connector housing connectable with a mating connector housing along a connector connecting direction, a plurality of L-shaped terminal fittings, each said terminal filling having a terminal main body insertable into the connector housing along an inserting direction, each said terminal fitting further having a wire fastening portion fastenable to a wire and extending in an extending direction that intersects the connector connecting direction, wherein the terminal fillings are accommodated at first and second stages in the connector housing, the terminal fillings accommodated at the first stage and those accommodated at the second stage being reversely oriented, such that the wire fastening portions of the L-shaped terminal fittings in the first stage extend in a first extending direction substantially perpendicular to the connecting direction and such that the wire fastening portions of the L-shaped terminal fittings in the second stage extend in a second extending direction directly opposite from the first extending direction and aligned substantially perpendicular to the connector connecting direction, the connector further comprising first wires connected to the wire fastening portions of the terminal fittings at the first stage and second wires connected to the wire fastening portions of the terminal fittings at the second stage and a retainer mounted to the connector housing and configured for guiding the first wires from the housing substantially in the first extending direction and for guiding the second wires from the connector substantially in the second extending direction, such that the second wires extend from the housing in directions directly opposite from the first housing.

7. A connector with a connector housing having opposite front and rear ends, the front end of the connector housing being connectable with a mating connector housing along a connector connecting direction, a plurality of mating terminal fittings mounted in the mating connector housing at first and second stages, such that the mating terminal fittings in the first stage are retracted along the connecting direction from the terminal fittings in the second stage, a plurality of L-shaped terminal fittings disposed in first and second stages in the connector housing, each said terminal fitting having a terminal main body inserted into the connector housing along an inserting direction that is substantially parallel to the connector connecting direction, the terminal main bodies of the L-shaped terminal fittings in the first stage projecting more forward than the terminal main bodies of the L-shaped terminal fittings in the second stage by a distance substantially equal to a retracted distance between the mating terminal fittings in the respective first and second stages of the mating connector housing, each said terminal fitting further having a wire fastening portion fastened to a wire and extending in an extending direction at the rear end of the connector housing, the extending direction being aligned substantially normal to the connector connecting direction, the wire fastening portions of the L-shaped terminal fittings in the first stage being offset from the wire fastening portions of the L-shaped terminal fittings in the second stage relative to the connector connecting direction for avoiding interference between the wire fastening portions of the L-shaped terminal fittings in the respective first and second stages, at least one retainer locked to the rear end of the connector housing and engaging a plurality of said terminal fittings for locking the terminal fittings in the connector housing.

8. A connector with a connector housing having opposite front and rear ends, the front end of the connector housing being connectable with a mating connector housing along a connector connecting direction, a plurality of L-shaped terminal fittings, each said terminal fitting having a terminal main body inserted into the connector housing along an inserting direction that is substantially parallel to the connector connecting direction, each said terminal fitting further having a wire fastening portion fastened to a wire and extending in an extending direction at the rear end of the connector housing, the extending direction being aligned substantially normal to the connector connecting direction, at least one retainer locked to the rear end of the connector housing and engaging a plurality of said terminal fittings for locking the terminal fittings in the connector housing, wherein the terminal fittings are accommodated at first and second stages in the connector housing such that the terminal fittings accommodated at the first stage and those accommodated at the second stage are oriented in opposite directions such that the wire fastening portions of the L-shaped terminal fittings in the first stage extend in a first extending direction and such that the wire fastening portions of the L-shaped terminal fittings in the second stage extend in a second extending direction directly opposite the first extending direction, the retainer having first projecting pieces disposed substantially adjacent the terminal fittings of the first stage and extending to a first side of the retainer for guiding wires from the terminal fittings of the first stage substantially in the first extending direction, the retainer further having second projecting pieces disposed substantially adjacent the terminal fittings of the second stage and extending to a second side of the retainer substantially opposite the first side for guiding wires from the terminal fittings of the second stage substantially in the second extending direction.

* * * * *